US005443400A

United States Patent [19]

Brown et al.

[11] Patent Number: 5,443,400

[45] Date of Patent: Aug. 22, 1995

[54] MULTIPLE OUTLET RECEPTACLE AND METAL STAMPING THEREFOR

[75] Inventors: Donald C. Brown, Freehold; Suzanne V. Hickey, Brick, both of N.J.

[73] Assignee: Heyco Stamped Products, Inc., Toms River, N.J.

[21] Appl. No.: 137,347

[22] Filed: Oct. 18, 1993

[51] Int. Cl.[6] ..... H01R 25/00

[52] U.S. Cl. ..... 439/650; 439/652

[58] Field of Search ..... 439/709–715, 439/638–655, 877, 92, 108

[56] References Cited

U.S. PATENT DOCUMENTS

| | | | |
|---|---|---|---|
| 2,677,115 | 4/1954 | Stevens | 439/654 |
| 3,668,615 | 6/1972 | Bury | 339/206 |
| 4,045,868 | 9/1977 | Ammon et al. | 29/629 |
| 4,188,715 | 2/1980 | Ammon et al. | 29/629 |
| 4,354,727 | 10/1982 | Brown | 439/654 |
| 4,462,656 | 7/1984 | Beyer | 439/655 |
| 4,546,542 | 10/1985 | Proud | 29/874 |
| 4,863,402 | 9/1989 | Black et al. | 439/736 |
| 5,044,993 | 9/1991 | El-Haj et al. | 439/668 |
| 5,074,039 | 12/1991 | Hillbish et al. | 29/883 |
| 5,148,596 | 9/1992 | Zahn | 29/842 |
| 5,171,168 | 12/1992 | Chiodo | 439/651 |

FOREIGN PATENT DOCUMENTS 329221 3/1991 Japan .

*Primary Examiner*—David L. Pirlot
*Attorney, Agent, or Firm*—Auslander & Thomas

[57] ABSTRACT

A multi-station stamped metal conductor in a multi-outlet receptacle enables the simplified molding of the receptacle with less parts and wire connections. The conductor has articulated stations coinciding with the individual outlets, each station having a female receptacle with an appropriate pin or blade opening. The conductors are easily held in position for molding of the receptacle. Each conductor requires only a single crimped conductor wire serving all of the stations. The molding may be done without change to prior art molds.

38 Claims, 11 Drawing Sheets

FIG.1
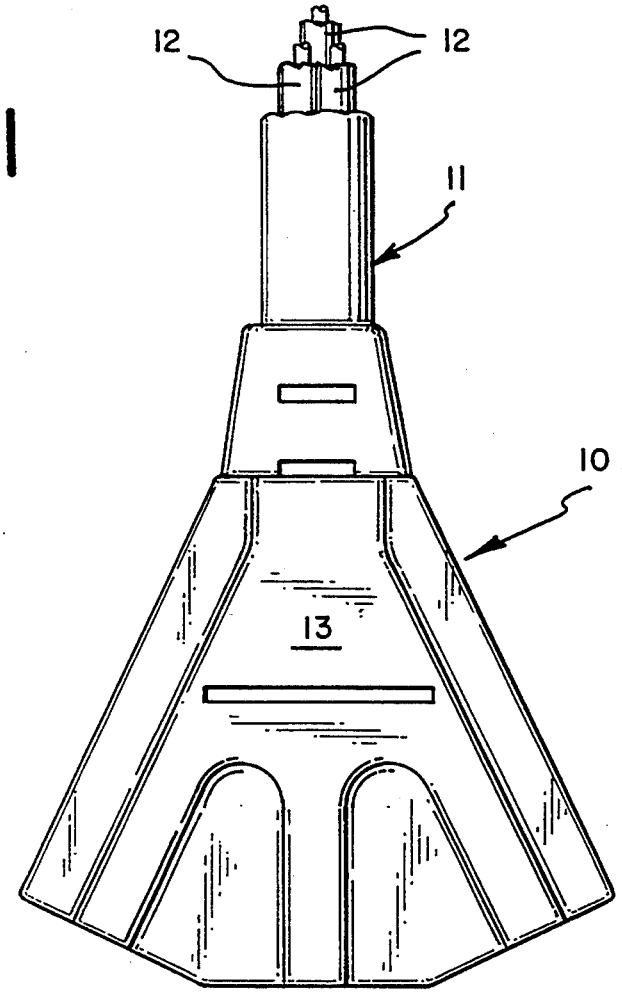
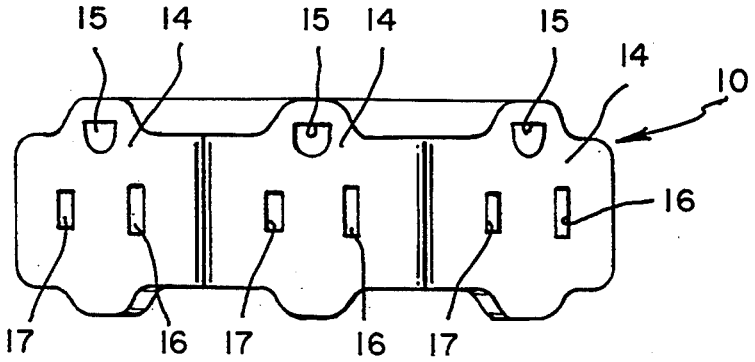
FIG.2

FIG.3
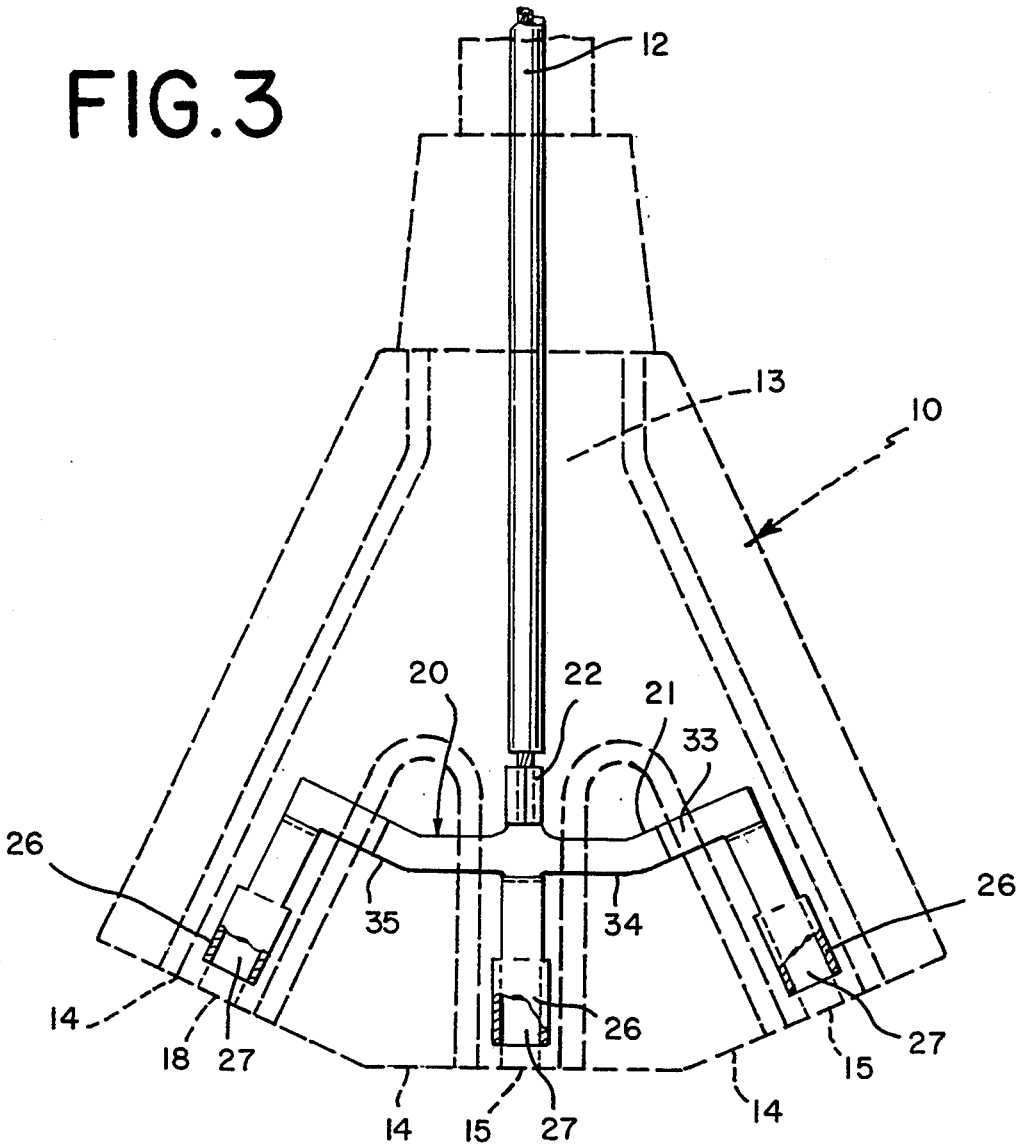
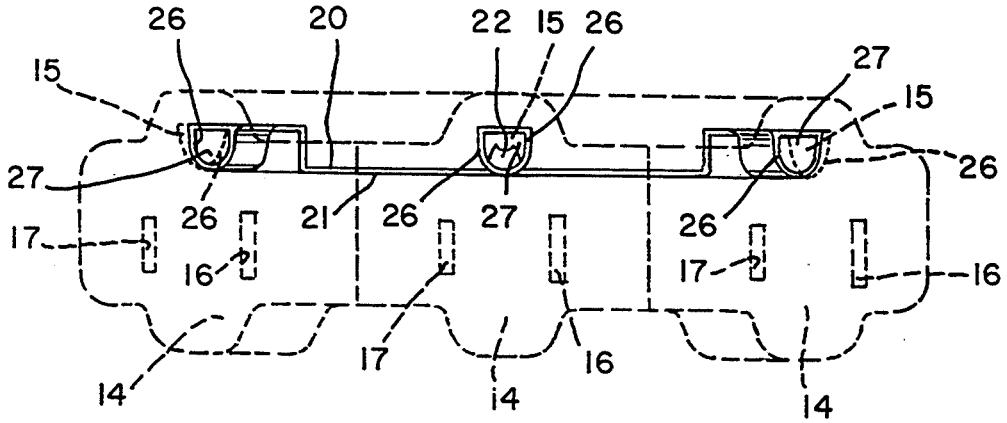
FIG.4

FIG.5
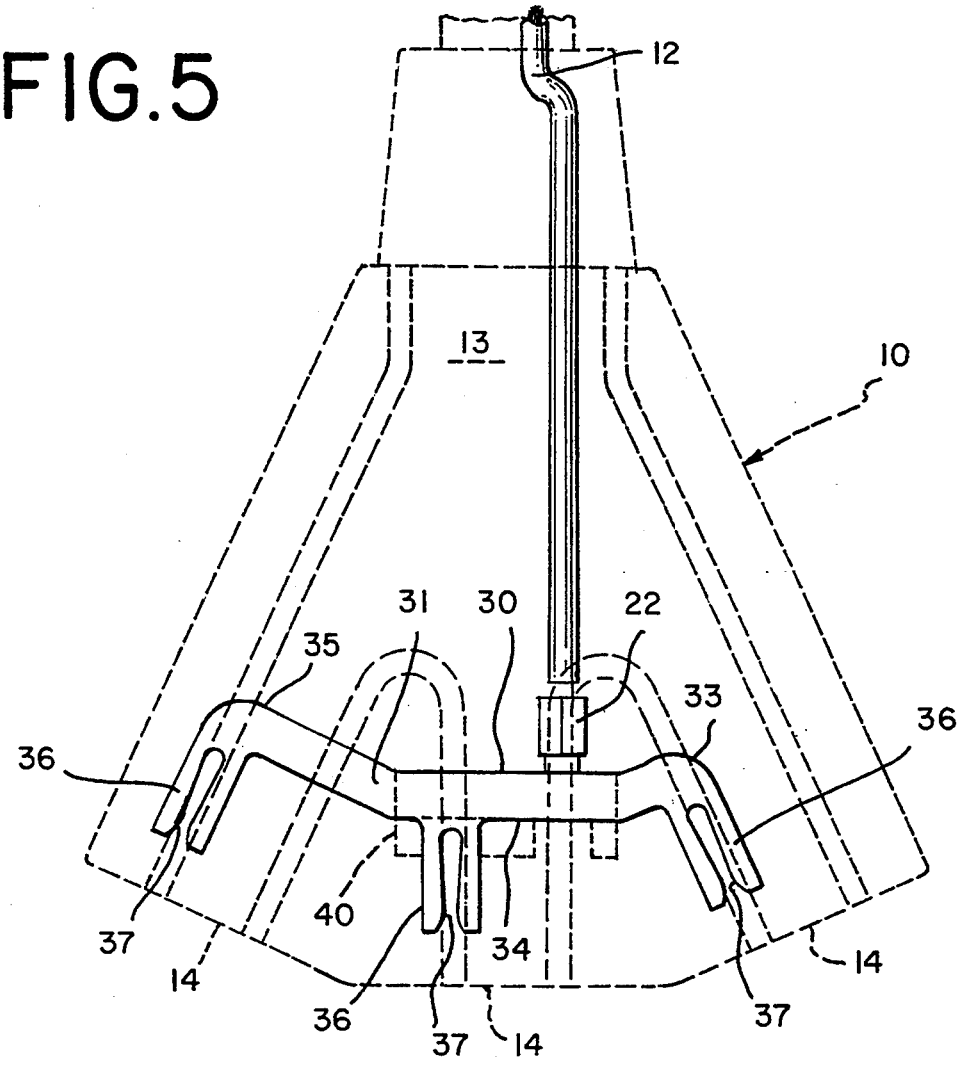
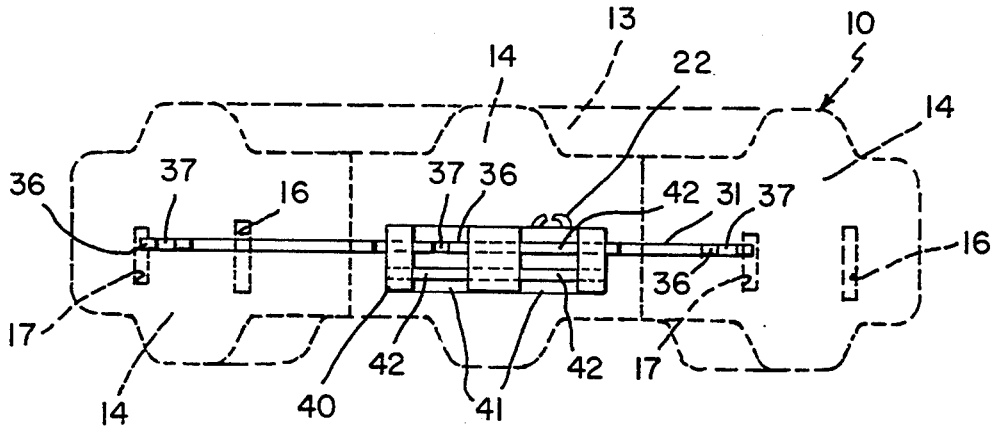
FIG.6

FIG.7
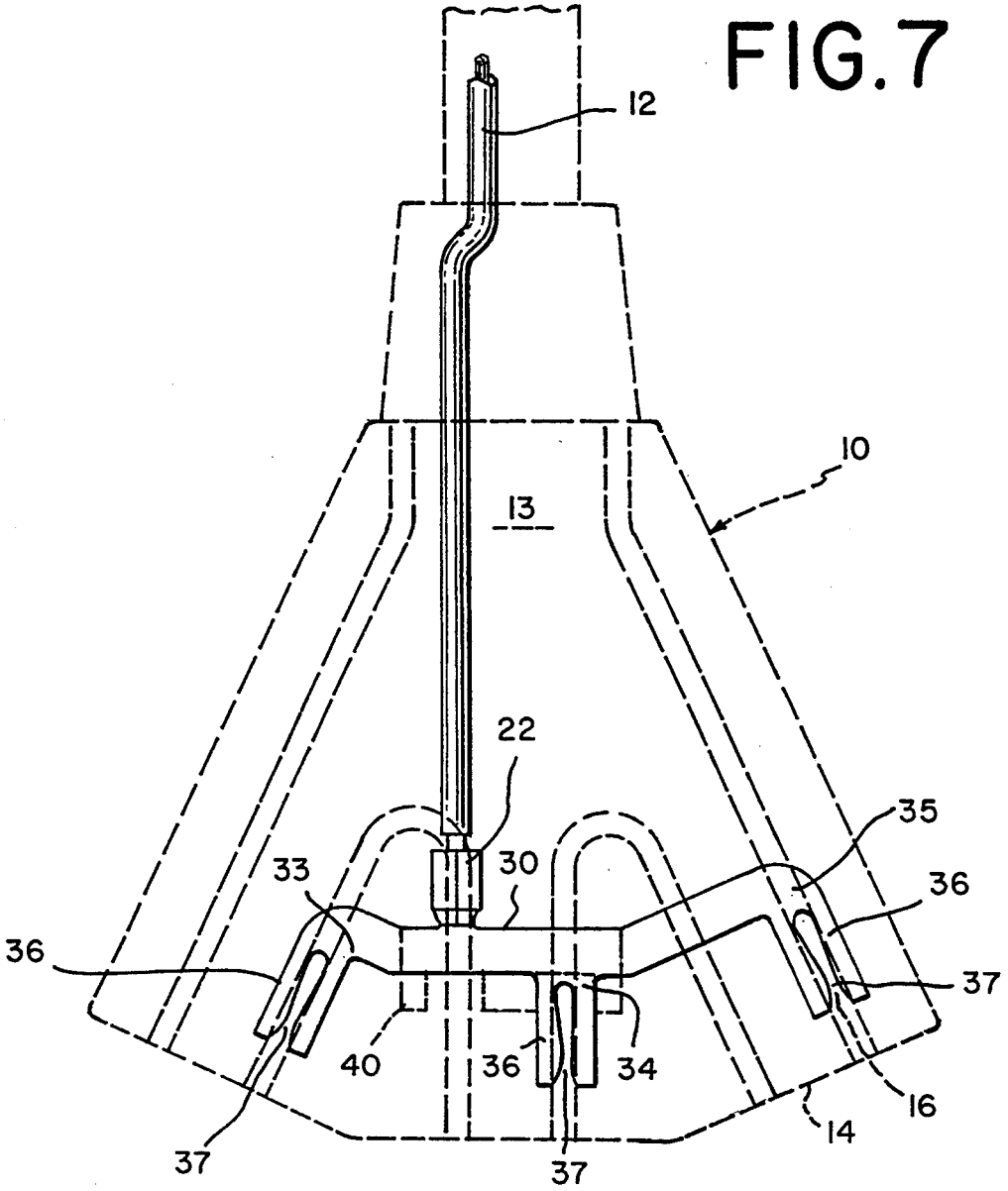
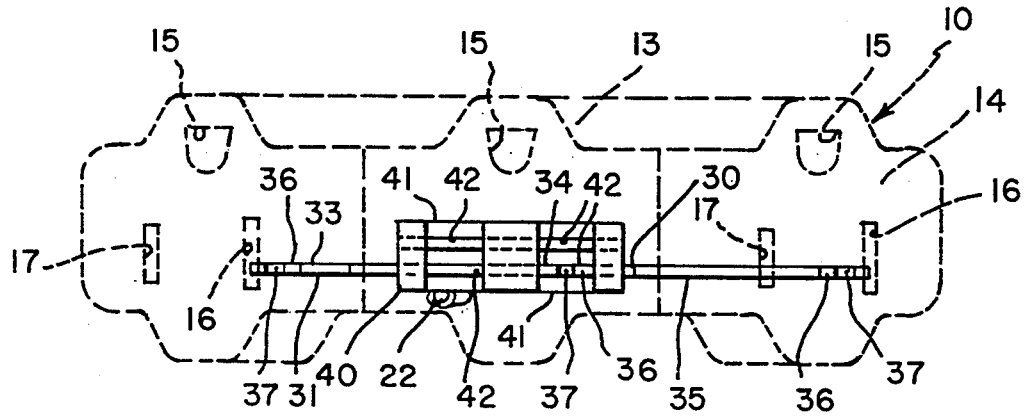
FIG.8

FIG.21
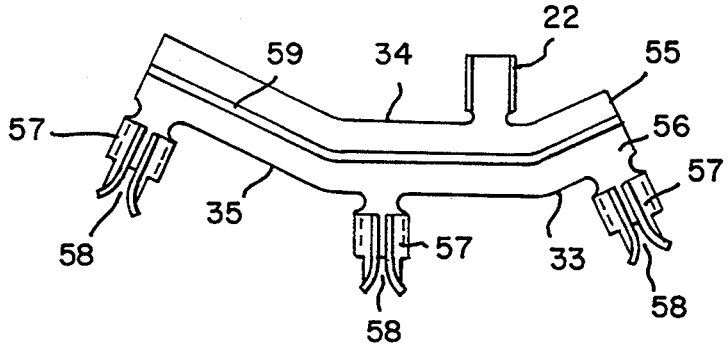
FIG.22
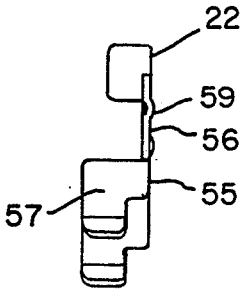
FIG.23
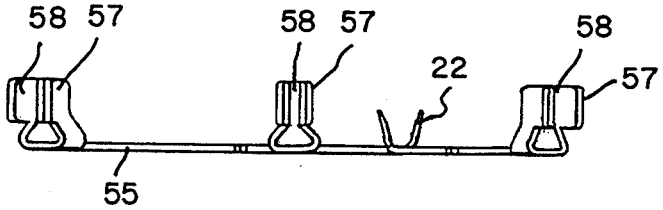
FIG.24
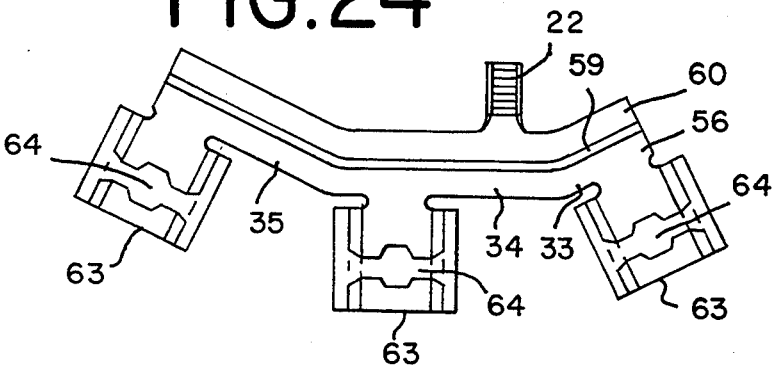
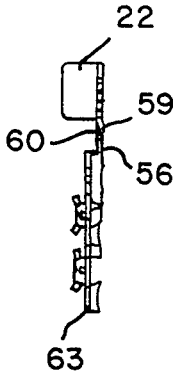
FIG.25
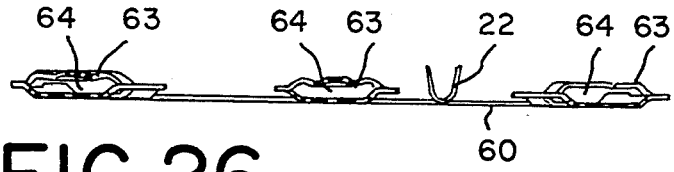
FIG.26

FIG.27
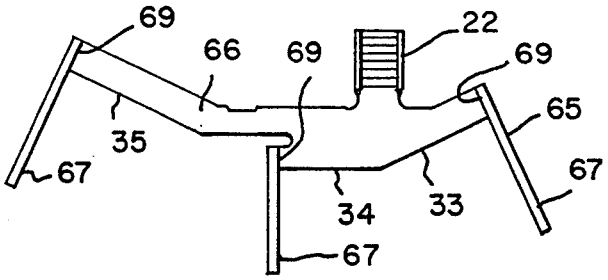
FIG.28
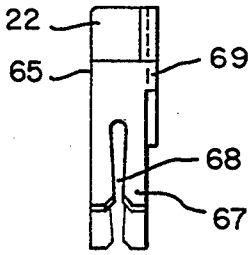
FIG.29
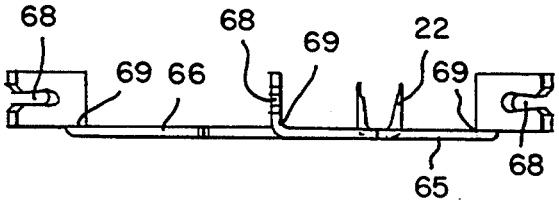
FIG.30
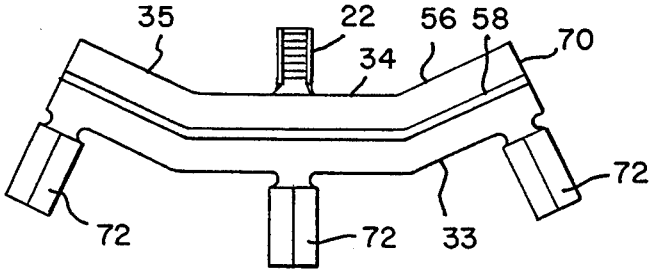
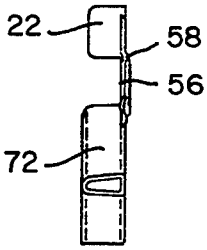
FIG.31
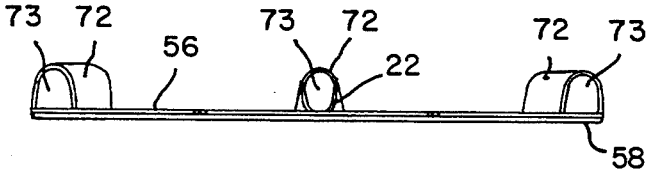
FIG.32

FIG.33
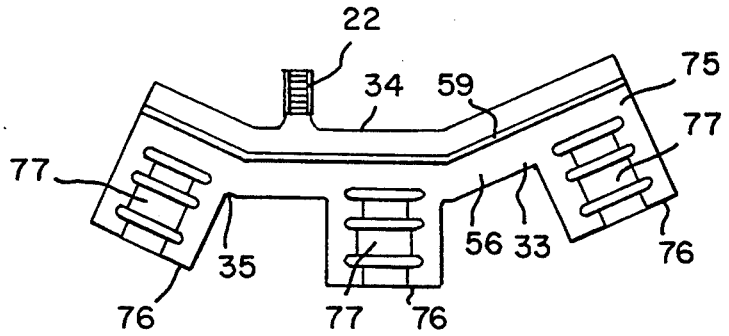
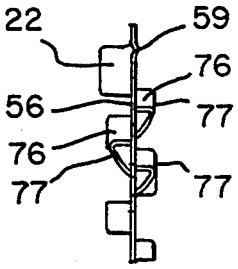
FIG.34
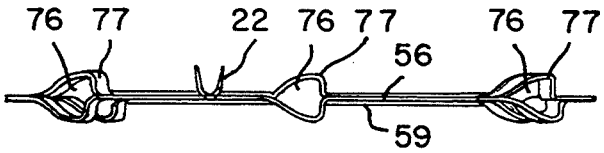
FIG.35

FIG.36
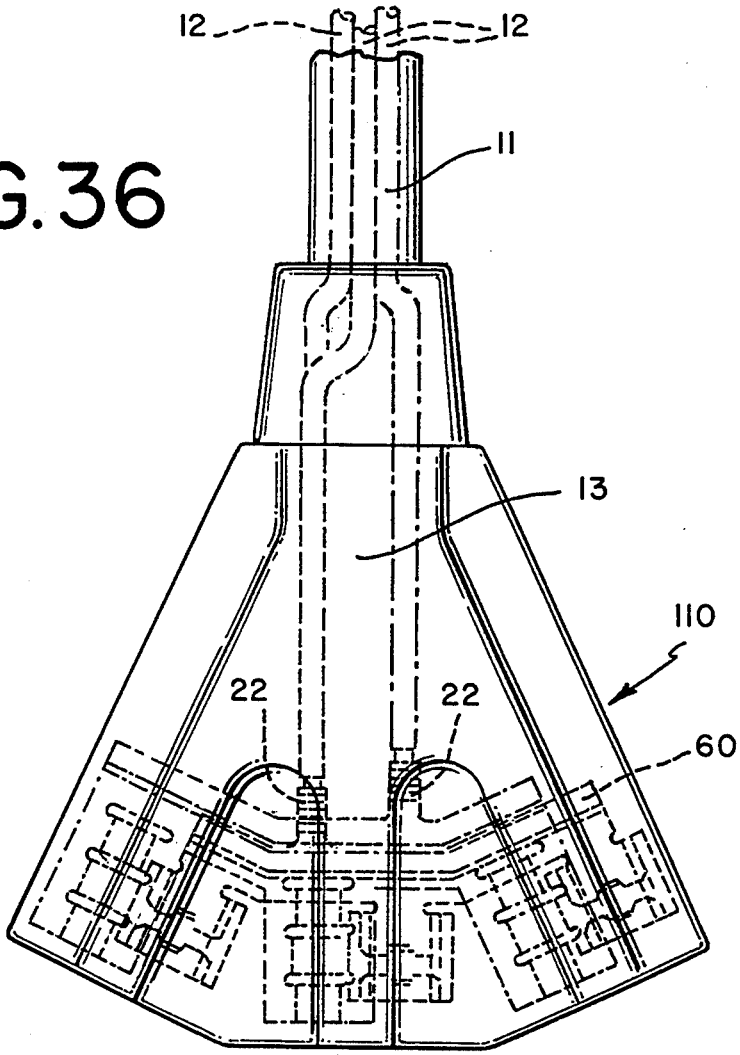
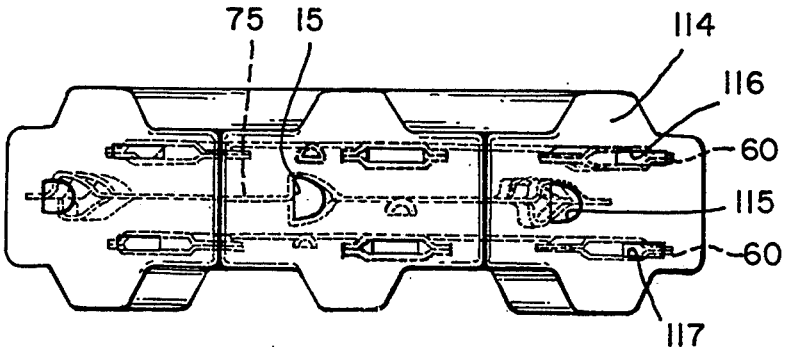
FIG.37

MULTIPLE OUTLET RECEPTACLE AND METAL STAMPING THEREFOR

BACKGROUND OF THE INVENTION

The present invention is a novel multiple outlet receptacle, some times referred to as a tee tap, particularly for a heavy duty electrical cable.

Multiple outlet receptacles for the plugging in of electricity for machinery in a factory for a wall outlet for the plugging in of power tools generally, have heavy duty electrical cable. Such multiple outlet receptacles generally have a flat array of polarized outlets for the male plugs in a single head, The connector plugs usually have a round or "U" shaped ground pin and blades. Each outlet usually has an opening to accept a round or "U" shaped ground pin and polarized openings for the blades, There are usually three outlets on each receptacle.

The prior art multiple outlet flat receptacle with three sets of outlets generally included nine female contacts and nine wire connections, three each, to each outlet.

Assembly of the receptacle required the connecting of nine wires to the nine female contacts, as well as the complexity of maintaining all parts together with load bars, during the molding process. The molding of the receptacle of the present invention can be done without changing prior art molds and load bars.

The manufacture of the prior art receptacle also required substantial labor, to get all the nine wires and pieces together for the molding of the receptacle even if the wires were automatically machine crimped to the contacts.

DESCRIPTION OF THE RELATED ART

Annexed hereto is Form PTO-1449 and copies of the patents and prior art cited therein.

U.S. Pat. No. 5,074,039 discloses a multi-opening electrical connector with separately acting contacts, molded and stamped, with multiple male and female connections.

U.S. Pat. No. 4,045,868 and 4,188,715 disclose a stamped and molded electrical connector with multiple connections and variously configured female and male contacts individually acting in a molded multi-opening receptacle, with individual wire connections for each female contact in the multiple plug. The contacts are press fit.

U.S. Pat. No. 3,668,615 discloses a receptacle for multiple male pins, each individually connected to a lead wire. The pins are crimped to conductors in a automated operation.

U.S. Pat. No. 5,044,993 discloses a connector system for different types of male and female contacts were the contacts are in a simplified on piece round configuration.

U.S. Pat. No. 4,546.542 discloses a stamped and molded electrical connector with multiple tine female contacts and male contacts individually acting in a molded multi-opening receptacle.

U.S. Pat. No. 5,148,596 discloses an assembly system for assembling multiple female contacts and multiple male contacts on a printed circuit board.

U.S. Pat. No. 4,863,402 discloses an assembly for assembling multiple female contacts where a conductor is accessable from more than one opening.

Japanese Patent No. 3-29221 discloses a single contact with multiple male contacts for a plug..

It is respectfully requested that this citation of art be made of record with regard to the Within application.

SUMMARY OF THE INVENTION

The present invention is a molded receptacle for a heavy duty electrical cable for male plugs. The connector plugs have a round or "U" shaped ground pin and blades. The outlets each have openings to accommodate the ground pin and blades.

A basic advantage of the present invention is the speed and economy of assembly and molding of the receptacle and outlets, with all the conductors connected and in place.

The prior art provided individual connections to each conductor. It was complicated and complex to mold with the concomitant additional labor and part cost.

The present invention provides modular articulated multi-station conductors. Thus, for each receptacle, only two type contact sets are required, a multi-station conductor for round or "U" shaped ground pins and two multi-station conductors for the other blades of the plug.

According to the present invention, a multi-outlet receptacle with at least two outlets in flat array, and articulated with regard to each other, has openings for male contacts on a plug. The receptacle has at least two unitary multi-station stamped metal conductors, each conductor having at least two stations. There is one station for each outlet. The conductor has a spine, female contact receptacles, one contact receptacle for each station and a conductor wire crimp end. The spine has one articulation between stations. The stations are oriented toward the outlets. The female contact receptacle is oriented to access one opening in one outlet. There is one conductor wire for each conductor. The conductors wires are crimped to the conductor's wire crimp end.

The female contact receptacles may be substantially evenly spaced from each other along spines and are receivers to accept blade contacts. When there are three conductors, the female contact receptacles on one of the three conductor may have receptacles, to accept round or "U" shaped pin contacts.

The female contact receptacles may include openings. When there are three conductors the openings in the female contact receptacles of two of the conductors are receivers to accept blade contacts. When there are three conductors, openings in female contact receptacles, of one conductor, are receivers to accept round or "U" shaped pin contacts.

The openings on the female contact receptacles on a conductor may be on a horizontal plane or even extending at a right angle to the spine.

The female contact receptacles on a conductor may be offset from the spine and may have an integral reenforcing ridge. The conductor wire crimp end on a conductor may be eccentric on the spine. The spine may include an arm.

An outlet in the receptacle may include more than two openings, the third being a round or "U" shaped pin contact opening. When there are three conductors, the female contact receptacles on one of the three conductors usually is a receptacle to receive a round or "U" shaped pin contact, the receptacle is accessable to the outlet ground pin contact opening and the female contact receptacle openings are receivers to accept blade contacts.

The outlet openings in the outlets may be at a right angle to the flat array of outlets with the ground pin opening of the outlets centered and openings in the female contact receptacles receiver blade contacts. The female contact receptacle matches the respective outlet opening.

The outlet openings in the outlets may be parallel to the flat array of outlets with the ground pin opening of the outlets centered and openings in the female contact receptacles receiver blade contacts. The female contact receptacle matches the respective outlet opening.

The outlets may have more than three openings, and there may be more than three outlets in a receptacle and the conductors may have more than three stations.

The conductors may be separated and held by a spacer.

The conductor has at least two stations. There is one station for each outlet. The conductor has a spine, female contact receptacles, one contact receptacle for each station and a conductor wire crimp end. The spine has one articulation between stations. The stations are oriented toward outlets. The female contact receptacle is oriented to access one opening in one outlet.

The female contact receptacles may be substantially evenly spaced from each other along spines and are receivers to accept blade contacts. The female contact receptacles may have receptacles to accept round pin contacts.

The female contact receptacles may include openings. The openings in the female contact receptacles are receivers to accept blade contacts. There are openings in female contact receptacles of conductors which are receivers to accept round pin contacts.

The openings on the female contact receptacles on a conductor may be on a horizontal plane, or even extending at a right angle to the spine.

The female contact receptacles on a conductor may be offset from the spine and may have an integral reenforcing ridge. The conductor wire crimp end on a conductor may be eccentric on the spine. The spine may include an arm.

The conductor may have more than three stations.

Although such novel feature or features believed to be characteristic of the invention are pointed out in the claims, the invention and the manner in which it may be carried, may be further understood by reference to the description following and the accompanying drawing.

BRIEF DESCRIPTION OF THE DRAWING

FIG. 1 is a top plan view of the molded receptacle of the present invention.

FIG. 2 is a front elevation of FIG. 1, showing three polarized outlets.

FIG. 3 is top plan view of FIG. 1, showing the receptacle, in phantom, with one type of articulated multi-station female ground pin contact, cut away, crimped to a conductor wire.

FIG. 4 is a front elevation of FIG. 3.

FIG. 5 is phantom top plan view of FIG. 1, showing a first of one type articulated multi-station female blade contact crimped to a conductor.

FIG. 6 is a front elevation of FIG. 5.

FIG. 7 is phantom top plan view of FIG. 1, showing a second articulated multi-station female blade contact of the type shown in FIG. 5 crimped to a conductor.

FIG. 8 is a front elevation of FIG. 7.

FIG. 21 is a top plan view of another embodiment of the female blade contact.

FIG. 22 is a side elevation of FIG. 21.

FIG. 23 is a front elevation of FIG. 21.

FIG. 24 is a top plan view of another embodiment of the female blade contact.

FIG. 25 is a side elevation of FIG. 24.

FIG. 26 is a front elevation of FIG. 24.

FIG. 27 is a top plan view of another embodiment of the female blade contact shown in FIG. 5.

FIG. 28 is a side elevation of FIG. 27.

FIG. 29 is a front elevation of FIG. 27.

FIG. 30 is a top plan view of another embodiment of the female ground pin contact shown in FIG. 3.

FIG. 31 is a side elevation of FIG. 30.

FIG. 32 is a front elevation of FIG. 30.

FIG. 33 is a top plan view of another embodiment of the female pin contact shown in FIG. 3.

FIG. 34 is a side elevation of FIG. 33.

FIG. 35 is a front elevation of FIG. 33.

FIG. 36 is top plan view of another embodiment of the receptacle, in phantom, showing a horizontal outlet configuration with a central ground pin opening.

FIG. 37 is a front elevation of FIG. 36.

Referring now to the figures in greater detail, where like reference numbers denote like parts in the various figures.

DESCRIPTION OF THE PREFERRED EMBODIMENTS

Figure 9:
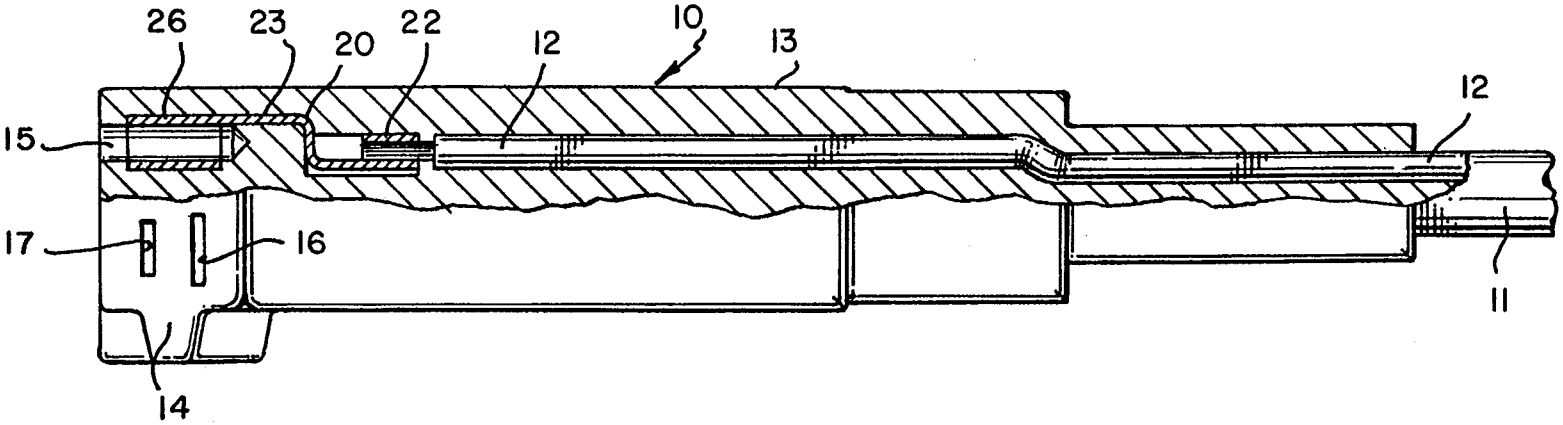
FIG. 9 is a cut away side view of FIG. 3 showing a section through the female ground pin contact.

FIG. 1 shows the multiple outlet receptacle 10. The multiple outlet receptacle 10 has a cable 11 with three insulated conductor wires 12 and a head 13.

As can be seen in FIG. 2, there are three outlets 14 in the head 13 of the receptacle 10. Each outlet 14 has a ground pin opening 15, a first polarized blade opening 16 and a second polarized blade opening 17. As shown in FIGS. 3 and 4, the multiple outlet receptacle 10 includes a multi-station stamped metal conductor 20 in the head 13. The conductor 20 has a spine 21, from which extends a conductor wire crimp end 22. The conductor 20 has a first station 33, a second station 34 and a third station 35. Each station 33–35 has a female contact receptacle 26 for a round or "U" shaped pin and an opening 27 to accept a round or "U" shaped pin. In FIGS. 5 and 6, the stamped metal conductor 30 has a spine 31, a first station 33, a second station 34, a third station 35 and a female contact receptacle 36. Each female contact receptacle 36 has an opening 37 for blade contacts. As can be seen in FIG. 6, the spine 31 of the stamped metal conductor 30 is engaged in a female contact receptacle slot 42 in the spacer 40. As shown in FIGS. 7 and 8, the stamped metal conductor 30 is inverted, in the head 13 of the receptacle 10, crimped to the insulated conductor wire 12 at the conductor wire crimp end 22. As shown in FIG. 8, the spine 31 of the stamped metal conductor 30 is engaged in female contact receptacle slot 42 in the spacer 40.

FIG. 9 is a detail side section through the conductor 20, showing the conductor 20, crimped with the crimp end 22, crimped to the insulated conductor wire 12.

Figure 10:
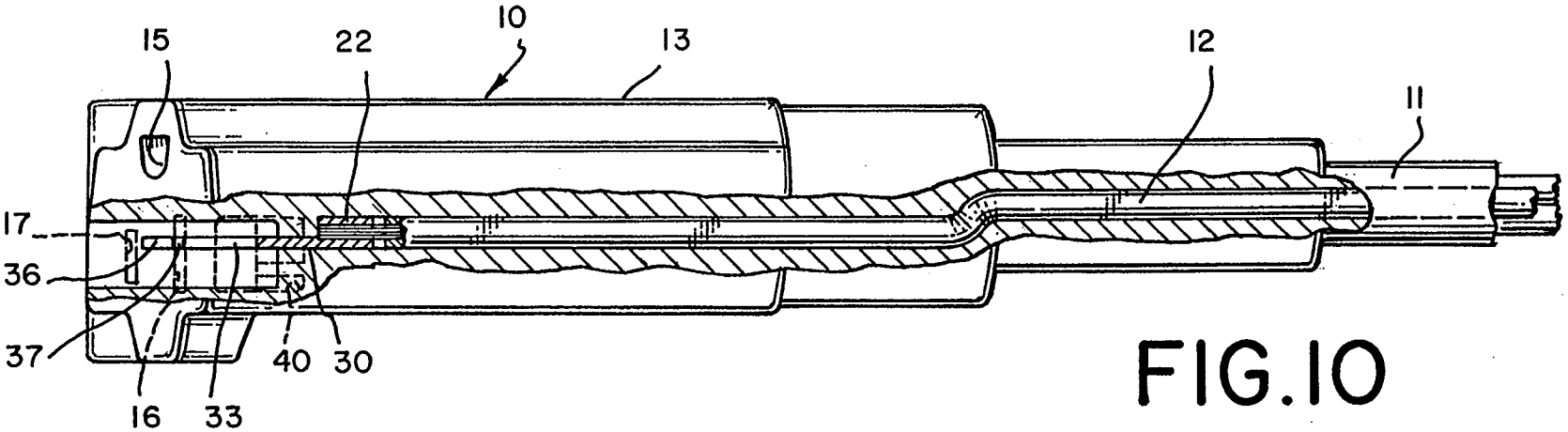
FIG. 10 is a cut away side view of FIG. 5 showing a section through showing the first female blade contact.

FIG. 10 is a detail side section through the conductor 30, in a spacer 40 and crimped with the crimp end 22, crimped to the insulated conductor wire 12.

Figure 11:
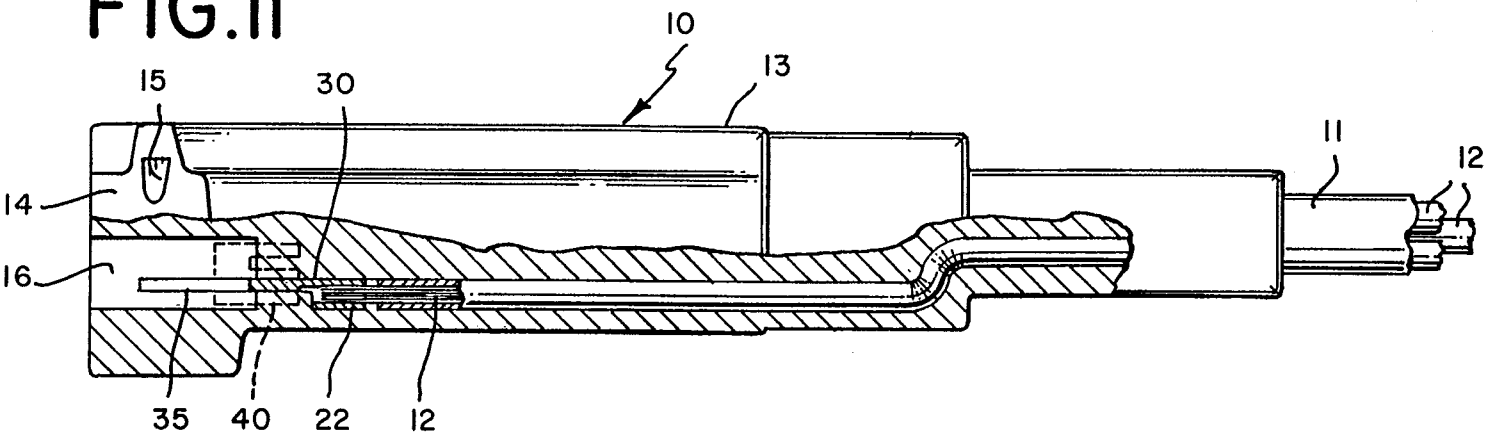
FIG. 11 is a cut away side view of FIG. 7 showing a section through showing the second female blade contact.

FIG. 11 is a detail side section of the inverted conductor 30, in a spacer 40 and crimped with crimp end 22, crimped to the insulated conductor wire 12, as shown in FIG. 8.

Figure 13:
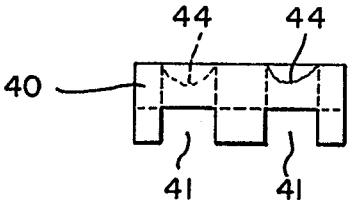
FIG. 13 is a front elevation of FIG. 12.
Figure 14:
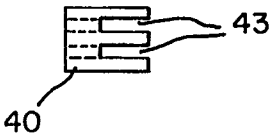
FIG. 14 is a side elevation of FIG. 12.
Figure 12:
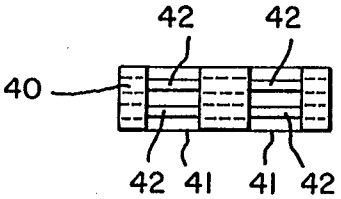
FIG. 12 is a top plan view of spacer for the female blade contacts shown in FIGS. 5–8, 10 and 11.

FIGS. 12 and 13 shows the spacer 40 with the female contact receptacle opening 41 and female contact receptacle slots 42. As shown in FIG. 14, there are spine slots 43. The spacer 40 may also have cutaways 44.

Figure 15:
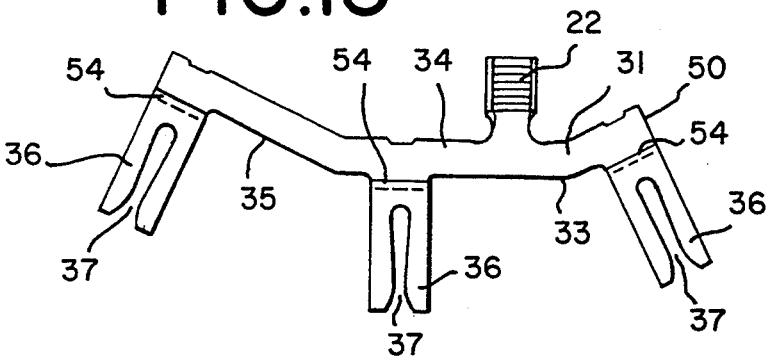
FIG. 15 is a top plan view of another embodiment of the female blade contact shown in FIG. 5.
Figure 16:
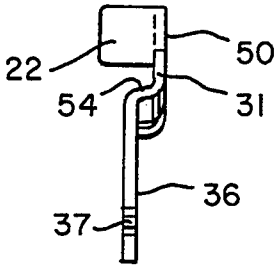
FIG. 16 is a side elevation of FIG. 15.
Figure 17:
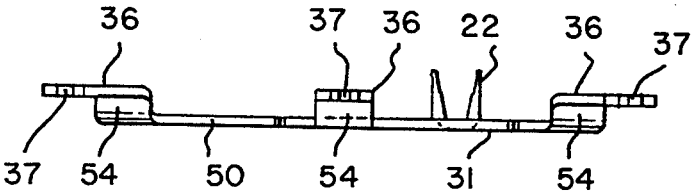
FIG. 17 is a front elevation of FIG. 15.

FIGS. 15, 16 and 17 shows the conductor 50 which is another embodiment of the conductor 30. The conductor 50 has a spine 31 and stations 33, 34 and 35 and a female contact receptacles 36, each with openings 37 for blade contacts. The conductor 50 includes an offset 54 between the spine 31 and the female contact receptacle 36.

Figure 18:
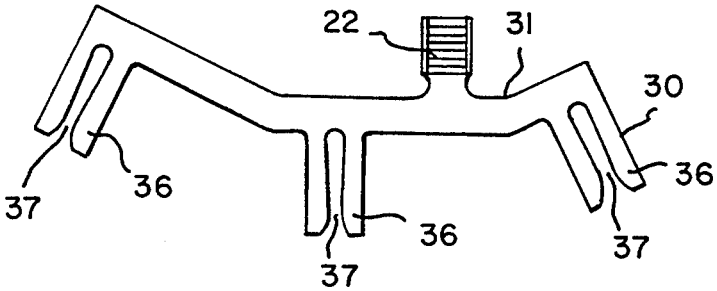
FIG. 18 is a top plan view of the embodiment of the blade contact shown in FIG. 5.
Figure 19:
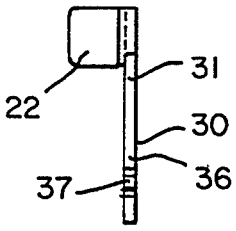
FIG. 19 is a side elevation of FIG. 18.
Figure 20:
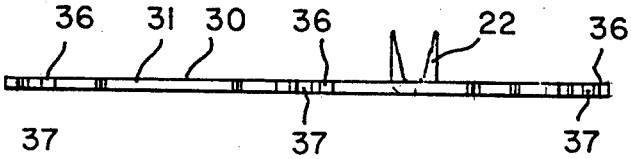
FIG. 20 is a front elevation of FIG. 18.

FIGS. 18, 19 and 20 show details of the conductor 30, shown in FIGS. 5, 6, 7, 8, 10 and 11.

FIGS. 21, 22 and 23 show another conductor 55 with a crimp end 22, a spine 56 with stations 33, 34 and 35, female contact receptacles 57 and openings 58 to accept a contact blades. The conductor 55 has a rigidizing ridge 59.

FIGS. 24, 25 and 26 show a conductor 60 which is another embodiment of the conductor 55. The conductor 60 has a a crimp end 22, a spine 56 with stations 33, 34 and 35, female contact receptacles 63 and openings 64 to accept blade contacts. The conductor 60 has a rigidizing ridge 59.

FIGS. 27, 28 and 29 show another conductor 65. The conductor 65 has a spine 66, stations 33, 34 and 35 and a female contact receptacles 67, each with openings 68 to accept blade contacts. The female contact receptacles 67 a right angle from the spine 66 at a bend 69.

FIGS. 30, 31, 32 show another conductor 70 with a crimp end 22, a spine 56 with stations 33, 34 and 35, female contact receptacles 72, openings 73 to accept a round or "U" shaped pin and a rigidizing ridge 59.

FIGS. 33, 34 and 35 show a conductor 75 which is another embodiment of the conductor 60. The conductor 75 has a a crimp end 22, a spine 56 with stations 33, 34 and 35, female contact receptacles 76 and openings 77 to accept or receive a round or "U" shaped pin and a rigidizing ridge 59.

As shown in FIGS. 36 and 37, the multiple outlet receptacle 110 includes two multi-station stamped metal conductors 60 in the head 13 and a conductor 75 spaced in between. FIG. 36 shows the multiple outlet receptacle 110. The multiple outlet receptacle 110 has a cable 11 with three insulated conductor wires 12 and a head 13.

As can be seen in FIG. 37, there are three outlets 114 in the head 13 of the receptacle 110. Each outlet 114 has a ground pin opening 115 centered in the middle of the head 13, a first polarized blade opening 116 horizontal to the head 13 and a second polarized blade opening 117 horizontal to the head. The conductor 60 are parallel to each other sandwiching the conductor 75 so that the opening 77 is offset centered in the outlet 114. Each of the crimp ends 22 is crimped to an insulated conductor wire 12.

OPERATION

As shown in FIGS. 1 through 11, a multiple outlet receptacle 10 has three outlets 14 in flat array in the head 13. The outlets 14 are preferably polarized with a ground pin opening 15, a first polarized blade opening 16 and a second polarized blade opening 17. The first polarized blade opening 16 and second polarized blade opening 17 are at a right angle to the flat array, with the ground pin opening 15 centered and at the top of the array.

The multiple outlet receptacle 10 is preferably molded in plastic and includes a heavy duty cable 11 with three insulated conductor wires 12. As shown in FIGS. 3 and 4 a multi-station stamped metal conductor 20 is molded into the head 13 with one of the insulated conductor wires 12 crimped to the conductor wire crimp end 22 of the conductor 20.

The conductor 20 has a spine 21 and three female contact receptacles 26 integral to the spine 21, on a first station 33, second station 34 and third station 35. The female contact receptacles 26 each include an opening 27 to accept a round or "U" shaped pin.

The stations 33 through 35 are articulated to address the outlets 14 so that the ground pin and blade contacts of a plug (not shown) may enter the outlet 14 openings 15 through 17 and engage the various female contact receptacle openings.

A single insulated conductor wire 12 crimped to the crimp end 22 of the conductor 20 serves three stations 33 through 35 replacing the prior art individual contacts with multiple crimped wires.

As shown in FIGS. 5 and 6, another insulated conductor wire 12 is crimped to a conductor 30 with stations 33 through 35 on an articulated spine 31. Each station has a female contact receptacle 36 including a opening 37 for blade contacts. The stations 33 through 35 are articulated to address the outlets 14 so that the blade contacts of a plug (not shown) may enter the outlet 14 openings 16 through 17 and engage the female contact receptacle openings 37.

A single insulated conductor wire 12 crimped to the crimp end 22 of the conductor 30 serves three stations 33 through 35 replacing the prior art individual contacts with multiple crimped wires.

In FIGS. 7 and 8, another insulated conductor wire 12 is crimped to an inverted conductor 30 with stations 33 through 35 on an articulated spine 31. As can be seen in FIG. 6 through 11 the spines 31 of the stamped metal conductors 30 are engaged in spine slots 43 in the spacer 40.

The spacer 40 is an aid that can be used in the preparation of the multiple outlet receptacle 10 particularly where the spines 31 and the female contact receptacles 36 are flat and the openings 37 for blade contacts are on a plane.

In the molding process for a receptacle 10, such as shown in FIGS. 1 through 11, a conductor 20 with a female contact receptacle 26 having openings 27 to accept a round or "U" shaped pin is crimped to an insulated conductor wire 12, as shown in FIG. 3. Two conductors 30 have their crimp ends 22 to other conductor wires 12. As can be seen in FIGS. 5 through 11, one conductor 30 is inverted, as shown in FIG. 5.

During the molding process, load bars or plugs, (not shown) equivalent to "D" shaped pins and flat blades, are loaded into the mold. The openings 27 engage the load bar equivalent of pins and the openings 37 engage the load bar equivalent blades. The load bars and the mold shape the openings 15, 16 and 17, which define the outlets 14.

Since the openings 37 grasp blades or load bars, primarily at two points, one on each side of the width of the blade, it can be seen that the conductor 20 might slide on the blades, or even slide off the blades, before molding.

Thus, in the embodiment of the receptacles 10, shown in FIGS. 1 through 11, the conductors 30 are engaged in the spacer 40, as a precaution. One female contact receptacle 36 of each conductor 30 is pushed through one of the slots 42 in the spacer 40 and extends through the opening 41 for a female contact receptacle 36. Spines 31 are engaged in the spine slots 43 of the spacer 40.

The openings 41 cradles the female contact receptacles 36 without covering the blade openings 37. The the female contact receptacle opening 41, in the molding process provides a full opening in the outlet 14 in the multiple outlet receptacle 10 up to the depth of the opening 37. A contact blade has full access to the opening 37.

As shown in the figures, the spines 31 are held and molded, separated and insulated against shorting, and the female contact receptacles 36 are positioned to an outlet to receive the polarized contact blades of a conventional plug.

While molding can be done without the spacer 40, the spacer 40 does prevent any unwanted sliding of the conductor 30 on the load bar before it is molded.

The load bar for the opening 27 in the female contact receptacle 26 holds the conductor 20 spaced away from the conductors 30. There is no risk of sliding in the pin to contact relationship with the load bar when the opening 27 to accept a "D" shaped pin has a load bar pin engaged, thus, the conductor 20 is firmly held and spaced for the purpose of molding.

The cutaway 44 in the spacer 40 allows extra space for the extension of the conductor wire 12 if it extends beyond the crimp 22.

The conductor 50, as shown in FIGS. 15 through 17, is substantially identical in look and application with the conductor 30, with the exception that the female contact receptacle 36 has an offset 54 from the spine 31. The offset 54 just repositions the female contact receptacle 36 within the polarized openings 16 and 17 of the outlet 14. The conductors 30 and 50 engage contact blades in outlets where the "D" shaped pin opening 15 is centered between the polarized blade openings 16, 17, with the opening configuration at a right angle to the array of outlets 14 as shown in FIGS. 1 through 11.

The conductor 55, as shown in FIGS. 21 through 23, is another embodiment of conductor, with female contact receptacles 57 adapted to receive blades in an outlet 14 which includes a ground pin opening 15 centered with the openings 16, 17 at a right angle to the array of outlets 14.

The conductor 70 as shown in FIGS. 21 through 23 is another embodiment of conductor for a ground pin, usable where outlets 14 are as shown in FIGS. 1 through 11.

The openings 37 and 57, it should be noted, are adapted to receive various widths of contact blades.

The conductor 60, as shown in FIGS. 24 through 26, has a female contact receptacle 63 with an opening 64 to accept a blade contact. The receptacle 63 is substantially parallel to the spine 56. The opening 64 is in the form of a stamped metal pocket.

The conductor 75, as shown in FIGS. 33 through 35, has female contact receptacles 76, similar to the contact receptacles 63, except that the opening 77 is stamped to receive a round or "U" shaped pin.

As shown in FIGS. 36 and 37, two conductors 60 are spaced in a multi-outlet receptacle 110, with outlets 114 aligned, so that the polarized blade openings 116, 117 are parallel to the array of the outlets 114 and with a ground pin opening 115 between and space away.

The conductor 65, in FIGS. 27 through 29, is similar to the conductors 30 in FIGS. 17 through 19 and FIGS. 15 through 17, with the exception that the female contact receptacle 67 off the spine 66, has a bend 69. The openings 68, thus, are adaptable to the outlet 114, where the polarized blade openings 116 and 117 are parallel to the array of outlets 114.

The articulation of the spines 31, 56 and 66 provide stations for the spaced ground pin openings 15, 115 and polarized blade openings 16, 116, 17, 117, so that multiple outlets 14 and 114 can receive conventional ground pin plugs, either with their blades parallel in the outlets 114, or at a right angle to the array of the outlet 14.

The multi stationing of each conductor of the present invention with the single crimp end 22, simplifies the prior art molding process for the receptacle 10, by reducing the number of insulated conductor wires 12 needed. The positioning of the conductors in the mold is stabilized on the load bars, providing a multi-outlet receptacle 10, which is faster to mold. There is also a saving of cost of labor. The prior art mold and load bars can be used without modification in making the multiple outlet receptacle 10.

The terms and expressions which are employed are used as terms of description; it is recognized, though, that various modifications are possible.

It is also understood the following claims are intended to cover all of the generic and specific features of the invention herein described, and all statements of the scope of the invention which, as a matter of language, might fall therebetween.

Having described certain forms of the invention in some detail, what is claimed is:

1. A unitary multi-outlet receptacle for male plugs, said receptacle including two substantially, flat parallel sides; and including at least two outlets, each said outlet including a face; said faces in flat array and at a substantially a right angle to said parallel sides; and radially aligned having a substantially common radius with regard to each other, each said outlet including at least two female openings for male contacts from a male plug, said receptacle including at least two unitary multi-station stamped metal conductors, each said conductor; being substantially planar; and having a spine said spine including a crimp end; and at least one said station for each said outlet, each said station including a female contact receptacle, said stations radially aligned and having a substantially common radius with regard to each other, said female contact receptacle at each station oriented to access one said opening in one said outlet, and at least two conductor wires; one conductor wire each for said conductors, each said conductor wire crimped to one said crimp end.

2. The invention of claim 1 wherein said female contact receptacles are substantially evenly spaced from each other along said spine.

3. The invention of claim 1 wherein said female contact receptacles on at least one said conductor are receivers to accept blade contacts.

4. The invention of claim 1 including at least three conductors wherein said female contact receptacles on one said at least three conductors are receptacles to accept ground 5. The invention of claim 1 wherein said female contact receptacles on at least one said conductor is offset from said spine.

6. The invention of claim 1 wherein said spine on at least one of said conductors includes an integral reenforcing ridge.

7. The invention of claim i wherein said crimp end on at least one of said conductors is offset from said spine.

8. The invention of claim 1 wherein said spine on at least one said conductor includes at least one arm.

9. The invention of claim 1 wherein at least one said face in said outlet includes more than three openings.

10. The invention of claim 1 including more than three said outlets in said receptacle and wherein at least one said conductor includes more than three stations.

11. The invention of claim 1 including at least one spacer, said at least two conductors separated by said at least one spacer.

12. The invention of claim 1 wherein said female contact receptacles include openings.

13. The invention of claim 12 including three conductors wherein said openings in said female contact receptacles of two of said conductors are receivers to accept blade contacts.

14. The invention of claim 12 including three conductors wherein said openings in said female contact receptacles of one said conductor are receivers to accept ground pin contacts.

15. The invention of claim 12, wherein said openings on said female contact receptacles on at least one said conductor are on a substantially horizontal plane with regard to said spine.

16. The invention of claim 12 wherein said openings on said female contact receptacles on at least one said conductor extend at a right angle to said spine.

17. The invention of claim 1 wherein at least one said outlet in said receptacle includes more than two openings.

18. The invention of claim 17 wherein at least one said outlet includes a ground pin contact opening.

19. The invention of claim 18 including at least three conductors wherein at least one said female contact receptacle on at least one said at least three conductors is a receptacle to receive a ground pin contact, said receptacle accessable to said outlet ground pin contact opening.

20. The invention of claim 19 wherein said female contact receptacles include openings.

21. The invention of claim 20 wherein at least one said opening in said female contact receptacles of two of said conductors is a receiver to a accept a blade contact.

22. The invention of claim 21 wherein at least one said opening in said female contact receptacles of one said conductor is a receiver to accept a ground pin contact.

23. The invention of claim 22 wherein at least two said outlet openings in said faces are at a right angle to said parallel sides of said receptacle with said ground pin opening of said outlets centered therebetween and spaced away, at least two said openings in said female contact receptacles of two of said conductors are receivers to accept a blade contact, and each said female contact receptacle is accessable to a respective outlet opening.

24. The invention of claim 22 wherein at least two said outlet openings in said at least two outlets are parallel to said parallel sides of said receptacle with said ground pin opening of said outlets centered therebetween and spaced away, at least two said openings in said female contact receptacles of two of said conductors are receivers to accept a blade contact, and each said female contact receptacle is accessable to a respective outlet opening.

25. A unitary multi-station stamped metal female conductor for a multi-outlet receptacle, said female conductor being substantially planar; and having a spine, said spine including a crimp end; and at least one said station for each said outlet, each said station including a female contact receptacle, said stations radially aligned and having a substantially common radius with regard to each other.

26. The invention of claim 25 wherein said female contacts are substantially evenly spaced from each other along said spine.

27. The invention of claim 25 wherein said female contact receptacles on at least one said conductor are receivers to accept blade contacts.

28. The invention of claim 25 wherein said female contact receptacles on are receptacles to receive ground pin contacts.

29. The invention of claim 25 wherein at least one said female contact receptacle is offset from said spine.

30. The invention of claim 25 wherein said spine includes an integral reenforcing ridge.

31. The invention of claim 25 wherein said crimp end is offset from said spine.

32. The invention of claim 25 wherein said spine includes at least one arm.

33. The invention of claim 25 wherein said conductor includes more than three stations.

34. The invention of claim 25 wherein said female contact receptacles include openings.

35. The invention of claim 34 wherein said openings are receivers to accept blade contacts.

36. The invention of claim 34 wherein said openings are receivers to accept ground pin contacts.

37. The invention of claim 34 wherein said openings are on a horizontal plane.

38. The invention of claim 34 wherein said are openings at a right angle to said spine.

* * * * *

UNITED STATES PATENT AND TRADEMARK OFFICE

CERTIFICATE OF CORRECTION

PATENT NO. : 5,443,400

DATED : August 22, 1995

INVENTOR(S) : Donald C. Brown, et al

It is certified that error appears in the above-identified patent and that said Letters Patent is hereby corrected as shown below:

Column 1, line 57, after "simplified" change "on" to -- one --

Column 2, line 58, after "integral" change "reenforcing" to -- reinforcing --

Column 4, line 8, after "of" insert -- the --

Column 7, line 24, change "openings" to -- opening --
line 25, after "The" delete "the" second occurrence Claim 4, line 4, after "ground" insert -- pin contacts. --
Claim 7, line 1, after "claim" change "i" to -- 1 --
Claim 30, line 2, change "reenforcing" to -- reinforcing --

Signed and Sealed this

Tenth Day of June, 1997

*Attest:*

Bruce Lehman

BRUCE LEHMAN

*Attesting Officer*

*Commissioner of Patents and Trademarks*